United States Patent [19]

Honda et al.

[11] 4,289,474

[45] Sep. 15, 1981

[54] PROCESS OF COMBUSTING A PREMIXED COMBUSTION FUEL

[75] Inventors: Juichi Honda, Fujisawa; Michiaki Matumoto, Tokyo; Sadao Mimori, Saitama, all of Japan

[73] Assignee: Hitachi, Ltd., Tokyo, Japan

[21] Appl. No.: 44,994

[22] Filed: Jun. 4, 1979

Related U.S. Application Data

[62] Division of Ser. No. 771,912, Feb. 25, 1977, abandoned.

[30] Foreign Application Priority Data

Mar. 1, 1976 [JP] Japan ..... 51-21115

[51] Int. Cl.[3] ..... F23M 3/04

[52] U.S. Cl. ..... 431/10; 431/351

[58] Field of Search ..... 431/10, 174, 177, 180, 431/181, 190, 252, 349, 351, 354; 239/419, 425, 568; 60/39.06

[56] References Cited

U.S. PATENT DOCUMENTS

| | | | |
|---|---|---|---|
| 878,461 | 2/1908 | Harris | 431/10 |
| 1,883,541 | 10/1932 | Campbell et al. | 431/174 |
| 2,190,768 | 2/1940 | Bryant | 431/177 |
| 3,051,464 | 8/1962 | Yeo et al. | 431/351 |
| 3,748,080 | 7/1973 | Dunn | 431/190 |
| 3,954,382 | 5/1976 | Hirose | 431/252 |
| 3,957,420 | 5/1976 | Asai | 431/190 |
| 4,021,188 | 5/1977 | Yamagishi et al. | 431/10 |

*Primary Examiner*—Carroll B. Dority, Jr.
*Attorney, Agent, or Firm*—Craig and Antonelli

[57] ABSTRACT

A gaseous fuel-air premix combustion burner is disclosed wherein the production of oxides of nitrogen can be inhibited. By blowing secondary air onto at least a maximum temperature region of a secondary reaction region of a gaseous fuel-air premix combustion flame, it is possible to minimize the production of oxides of nitrogen not only in regions of the flame where the volume of primary air is smaller or larger than the theoretical volume of air but also in the vicinity of a region of the theoretical volume of air, whereby the area of a region where the production of oxides of nitrogen is reduced can be increased.

12 Claims, 13 Drawing Figures

PROCESS OF COMBUSTING A PREMIXED COMBUSTION FUEL

This is a division of application Ser. No. 771,912, filed Feb. 25, 1977 and now abandoned.

This invention relates to a burner which is capable of inhibiting the production of oxides of nitrogen.

Heretofore, proposals have been made to use a burner of the two-stage combustion system in which the volume of primary air is reduced or a burner in which a lean fuel-air premix containing a larger proportion of primary air to gaseous fuel is burned, in order to inhibit the production of oxides of nitrogen. However, these solutions to the problem of minimizing the production of oxides of nitrogen have been unable to achieve satisfactory results, because the production of oxides of nitrogen shows a sharp increase in a region where the volume of primary air reaches the level of the theoretical volume of air and the area of a region where the production of oxides of nitrogen is reduced is very small in burners of the prior art.

A commonly used gaseous fuel-air premix combustion burner of the prior art will be described with reference to FIGS. 1, 2 and 3. The numeral 1 designates a burner flame port to which a premix of primary air and gaseous fuel is supplied and burns on the downstream side of the burner flame port 1. Thus, in the flame, a primary reaction region A and a secondary reaction region B disposed on the downstream side thereof are formed. Secondary air 2 is supplied freely to the flame from the surrounding atmosphere. In the figures, the maximum temperature shown is that of a flame whose gas is of $CH_4$.

As shown in FIG. 2, the primary reaction region A is a region where the fuel is mainly decomposed into CO and $H_2$, and the secondary reaction region located downstream of the primary reaction region A is a region where the CO and $H_2$ produced in the primary reaction region A are mainly oxidized into $CO_2$ and $H_2O$ respectively.

Meanwhile the rate of production of NO, which accounts for the major portion of oxides of nitrogen, is much lower than the rate of oxidization of CO and $H_2$, and NO continues to increase in amount even in a region of the flame which lies beyond the secondary reaction region B until finally it attains an equilibrium concentration.

It is known that the equilibrium concentration becomes as high as 3000–5000 ppm when the volume of primary air is at the level of the theoretical volume of air, if a flame is thermally insulated to prevent dissipation of heat therefrom and the temperature of the flame is maintained at the heat insulated theoretical combustion temperature. However, in actual practice, the temperature is maximized in a region slightly downstream of the primary reaction region A and the maximum temperature becomes substantially equal to the heat insulated theoretical combustion temperature. However, since the temperature gradually becomes lower due to dissipation of heat from the flame, the final amount of NO produced is several hundred ppm. Thus, prolonged holding of the flame at elevated temperatures causes an increase in the amount of NO product. Also, as shown in FIG. 3, a rise in temperature increases the rate at which NO is produced, so that a large amount of NO is produced even if NO is held at elevated temperatures for a short period of time. A rise by about 30° C. in the temperature of a flame increases twofold the rate of production of NO. Since the temperature of a flame produced by combustion is maximized in a region where the volume of primary air is near the level of the theoretical volume of air, a large amount of NO is produced even if NO is held at elevated temperatures for a short period of time. In burners of the prior art, it has hitherto been impossible to inhibit the production of oxides of nitrogen in a region where the volume of primary air is near the level of the theoretical volume of air.

This invention has as its object the provision of a burner in which the production of oxides of nitrogen is minimized not only in regions where the volume of primary air is smaller or larger than the theoretical volume of air but also in the vicinity of a region of the theoretical volume of air.

Additional and other objects and advantages of invention will become apparent from the description set forth hereinafter when considered in conjunction with the accompanying drawings.

Figure 4:
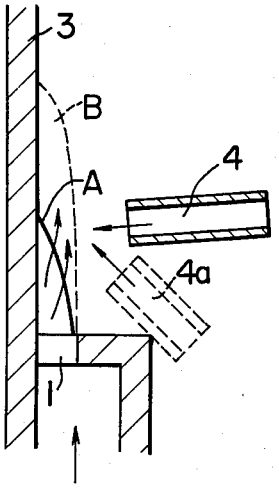
FIG. 4 is a vertical sectional view of the burner comprising one embodiment of the invention.
Figure 5:
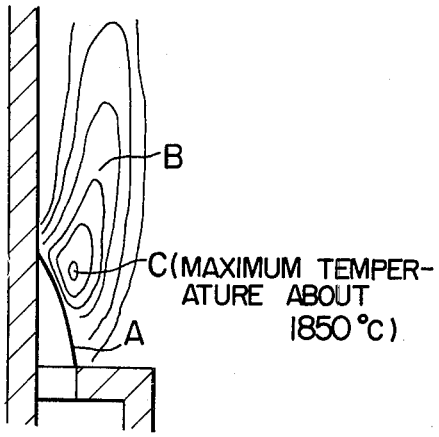
FIG. 5 is a vertical sectional view of the flame of FIG. 4 showing the temperature of the flame when no secondary air is blown onto the flame.

One embodiment of the invention will be described with reference to FIG. 4 in which a burner flame port 1 is located adjacent a cooling wall 3 through which heat is transferred to air or liquid. A premix of primary air and gaseous fuel flows out of the burner flame port 1 and passes along the cooling wall 3 to produce a flame including a primary reaction region A and a secondary reaction region B disposed downstream of the region A, both regions being in contact with the cooling wall 3. The numeral 4 designates a secondary air ejecting opening through which secondary air is blown onto a portion of the flame where the temperature thereof is maximized (hereinafter referred to as a maximum temperature region C) or the vicinity thereof. As shown in FIG. 5, the maximum temperature region C exists in the center of a portion of the flame disposed slightly posterior to the primary reaction region A. In FIG. 5, there is shown a temperature distribution of a flame which, as has hitherto been practiced, receives a supply of secondary air from the surrounding atmosphere without having secondary air blown onto it through the secondary air ejecting opening 4 as shown in FIG. 4. The gas is of $CH_4$.

Figure 1:
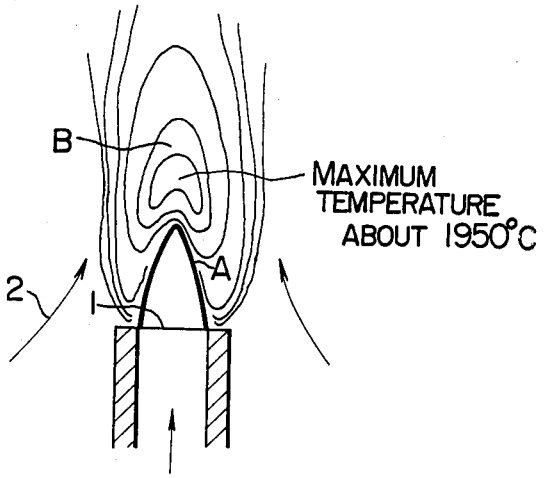
FIG. 1 is a vertical sectional view of a flame of a gaseous fuel-air premix combustion burner of the prior art showing a temperature distribution in the flame.
Figure 2:
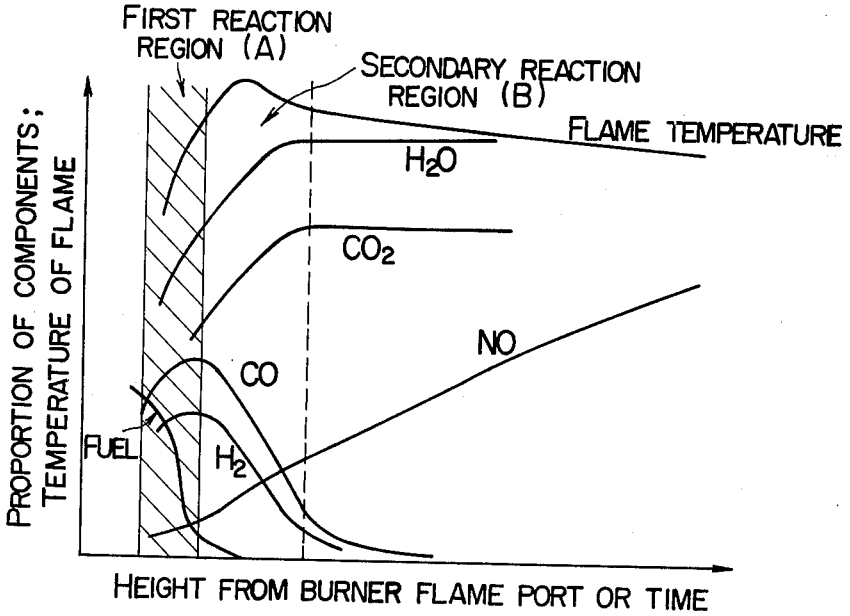
FIG. 2 is a graph showing the relation between the height of a flame from the flame port of the burner on one hand and the temperature of the flame and the proportions of various components on the other.
Figure 3:
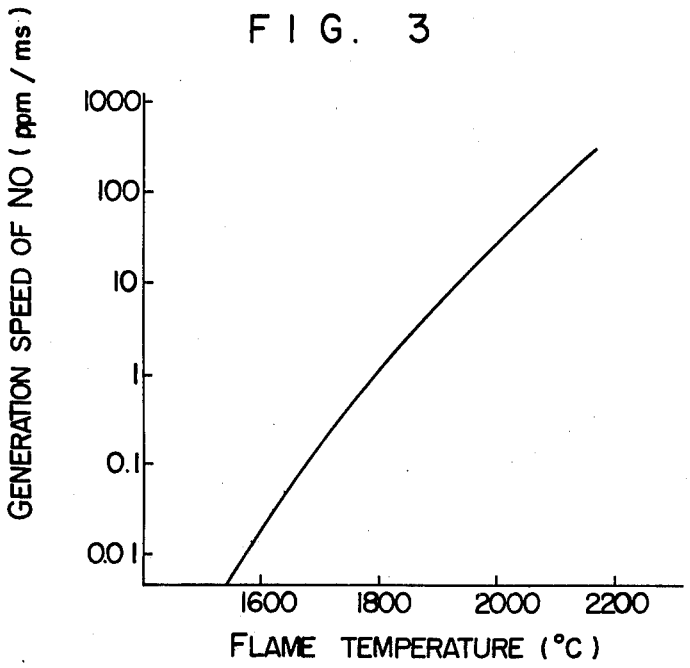
FIG. 3 is a graph showing the relation between the temperature of a flame produced by the combustion of a gaseous fuel-air premixed mixture of the theoretical mixture ratio and the rate of production of NO by this combustion.

By arranging the burner flame hole as shown in FIGS. 4 and 5, the maximum temperature of the flame is lowered, as shown in FIG. 5, by about 100° C. more than that of a flame of a conventional burner, since heat is rapidly removed from the flame by the cooling wall 3, and the rate of production of NO is reduced to 1/7 that of the flame of the prior art shown in FIG. 1. Also, since the temperature of a portion of the flame disposed adjacent the cooling wall 3 is lower than that of any other portion thereof, the proportion of an elevated temperature portion to a low temperature portion in the flame is smaller than in the flame of the prior art shown in FIG. 1, so that the amount of NO produced can be reduced.

Figure 6:
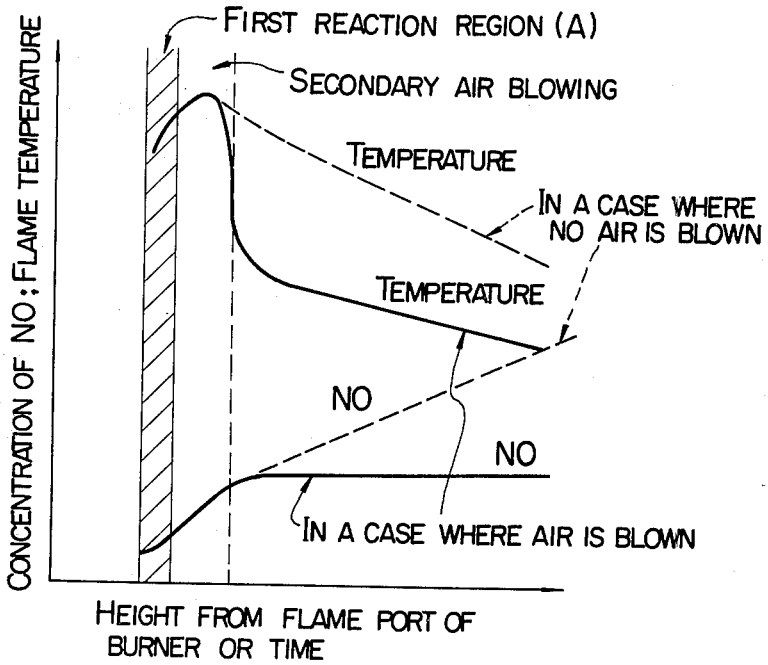
FIG. 6 is a graph showing the relation between the height from the flame port of the burner shown in FIGS. 4 and 5 or time, on one hand, and the temperature of the flame and the concentration of NO, on the other hand.

Additionally, in case no secondary air is blown onto the flame, the temperature of the flame is only gradually lowered in going toward the downstream portion thereof as shown in FIG. 6, with the result that the amount of NO produced continues to increase and reaches a high level. However, if secondary air is blown onto the maximum temperature region C which is slightly posterior to the primary reaction region A, then the temperature of the flame is rapidly lowered, so that the production of NO ceases and the amount of NO produced is greatly reduced. It has been found that the best result can be achieved when secondary air is blown onto the maximum temperature region C which is slightly posterior to the primary reaction region A. By blowing secondary air onto the flame as aforesaid, it is possible to reduce the amount of NO produced even in a region of the flame which is posterior to the maximum temperature region C, but the effect of reducing the amount of NO produced is lessened in going further away from the maximum temperature region C in the downstream direction. If secondary air is blown onto the primary reaction region A which is anterior to the maximum temperature region C, there arises the trouble of the flame becoming unstable or producing a noise of combustion (turbulent flow combustion noise).

Also, if the flame is cooled, then an elevated temperature portion of the flame tends to move away from the cooling wall 3. However, by blowing secondary air onto the flame, all the portions of the flame can be brought into contact with the cooling wall 3 in a favorable condition, so that cooling can be effected satisfactorily.

If a secondary air ejecting opening 4*a* is arranged as shown in broken lines in FIG. 4 in such a manner that a supply of secondary air is directed from the upstream side of the flame toward the downstream side thereof, the secondary air performs the function of stretching the flame along the cooling wall 3. Thus, cooling of the flame performed by utilizing the cooling wall 3 can be done more effectively and the production of oxides of nitrogen can be further inhibited.

Figure 7:
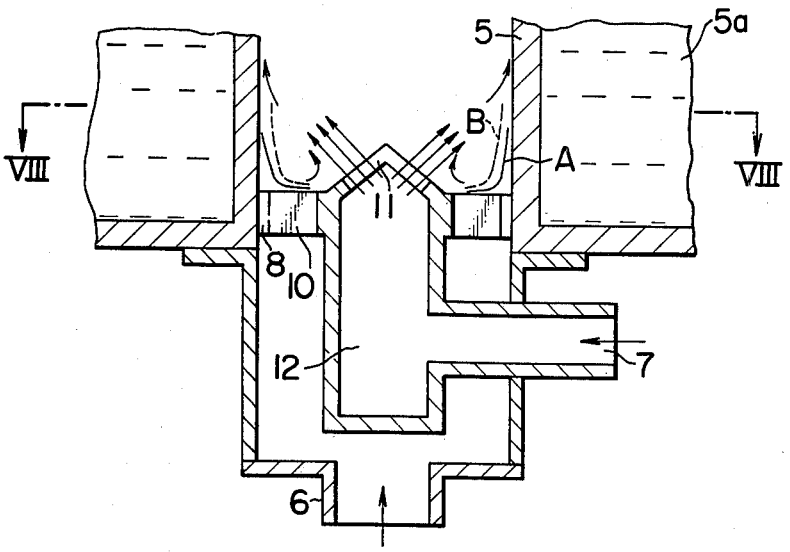
FIG. 7 is a vertical sectional view of the burner comprising another embodiment of the invention.
Figure 8:
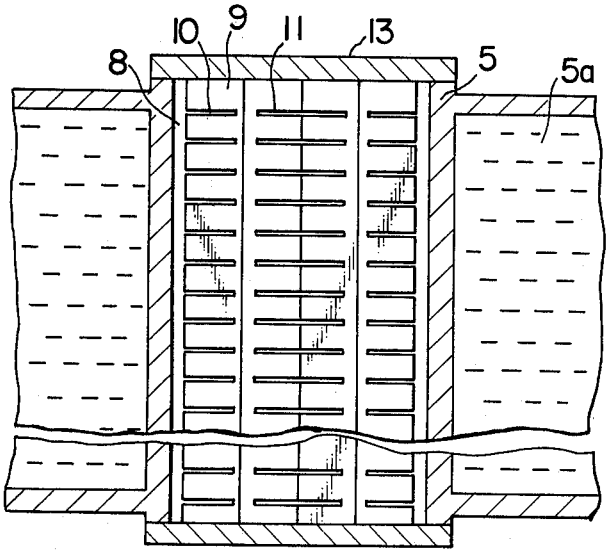
FIG. 8 is a view taken along the line VIII-VIII of FIG. 7.

FIGS. 7 and 8 show another embodiment of the invention in which the construction of the burner is in a more concrete form than the embodiment shown in FIG. 4. The numeral 5 designates cooling walls each maintained at an outer surface thereof in contact with a body 5*a* to be heated, such as water. The numeral 6 designates a fuel-air premixed mixture inlet conduit, and the numeral 7 designates a secondary air inlet conduit. Main flame ports 8 are each in the form of a slit interposed between an inner surface of one of the cooling walls 5 and one of flame hole plates 9. Auxiliary flame ports 10 each consist of a plurality of slits of a width narrower than the width of the main flame slits 8 and are located adjacent the main flame slits 8 on a side thereof opposite the cooling walls 5. The auxiliary flame slits 10 are disposed such that their longitudinal axes are at right angles to the longitudinal axes of the main flame slits 8. A plurality of secondary air ejecting openings 11 are provided in the central portion of the burner in a manner to be oriented in the direction of flow of the flames and toward the cooling walls 5. The secondary air ejecting openings 11 are shaped such that their longitudinal axes extend in a direction from the upstream side toward the downstream side of the flames. The secondary air ejecting openings 11 are formed by cutting, from the apex of a top cover of a secondary air passage 12 which is triangular in cross-sectional shape, into two sloping sides of the top cover. The numeral 13 designates end plates which close the longitudinal ends of the burner. Although not shown, spacers are provided so that the main flame slits 8 may have a suitable width and a suitable vertical position.

The burner constructed as aforesaid operates such that a premix of gaseous fuel and primary air introduced through the fuel-air premixed mixture inlet conduit 6 flows out of the main flame slits 8 and auxiliary flame slits 10. Since the auxiliary flame slits 10 each have a width which is smaller than that of the main flame slits 8, a great resistance is offered by the auxiliary flame slits 10 to the passage of the fuel-air premixed mixture and the velocity of streams of the fuel-air premixed mixture flowing out of the auxiliary flame slits 10 is lower than that of streams of fuel-air premixed mixture flowing out of the main flame slits 8. Thus the auxiliary flame slits 10 can provide small flames which are stable in shape. The fuel-air premixed mixture flowing out of the main flame slits 8 passes in streams along the cooling walls 5 so as to form flames which are maintained in contact with the cooling walls 5. That is, the primary reaction region A is formed on the downstream side of each of the main flame slits 8, and the secondary reaction region B is formed on the downstream side of the primary reaction region A. The secondary air introduced through the secondary air inlet conduit 7 is blown, through the secondary air ejecting openings 11 formed in the vicinity of the auxiliary flame slits 10, onto the downstream portion of the burning gas toward the cooling walls 5 in a manner such that the flames are stretched in the downstream direction thereof. Thus the flames are cooled in the same manner as described with reference to FIG. 4 and the production of oxides of nitrogen is inhibited.

Figure 9:
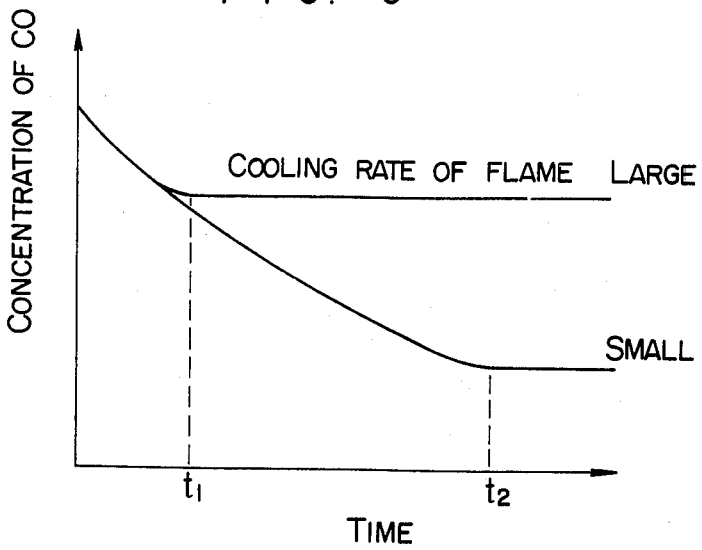
FIG. 9 is a graph showing the relation between the rate of cooling of a flame and the tendency of a reduction in the concentration of CO due to oxidization thereof with the lapse of time at two different cooling rates of the flame.

However, if the flames are cooled too much, CO will freeze without being oxidized into $CO_2$. Oxidization of CO takes place much faster than the production of NO. However, as shown in FIG. 9, if CO is cooled at a suitable rate, CO will be oxidized into $CO_2$, but if the cooling rate is high, CO will freeze because it undergoes insufficient oxidization reaction.

In the embodiment shown in FIGS. 7 and 8, a plurality of secondary air ejecting openings 11, which are in the form of slits, are arranged in a manner such that their longitudinal axes are oriented at right angles to the direction of flow of the flames and spaced apart from one another a suitable distance. By this arrangement, the secondary air flows from the openings 11 in a plurality of jet streams which have longitudinal axes oriented in cross-section in the direction of flow of the flames and cut the flames crosswise into a plurality of portions of flames. Thus discrete portions of the flames are sandwiched by the jet streams of secondary air and gradually cooled at an optimum rate, so that the flames are not quickly cooled and CO is sufficiently oxidized to be converted into $CO_2$.

Figure 10:
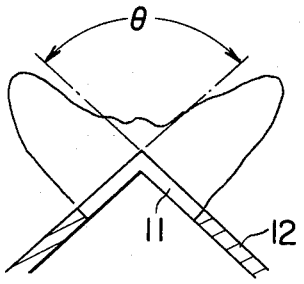
FIG. 10 shows the condition in which secondary air flows out through the secondary air ejecting openings of the burner shown in FIG. 7.

The manner in which secondary air is blown through the secondary air ejecting openings 11 of the shape shown in FIG. 7 will be described. As shown in FIG. 10, each of the secondary air ejecting openings 11 is formed in the apex of the triangular-shaped top cover of the secondary air passage 12 and extends in slit form along opposite sloping sides of the top cover of the passage 12. The volume of secondary air ejected through the apex portion is small and the majority of the secondary air is ejected through the sloping side portions approximately vertically of the sloping side portions, so that it is possible to blow the majority of the supplied secondary air onto the predetermined region of each of the flames disposed along the cooling wall surfaces. Thus the secondary air ejecting openings 11 can be formed readily by applying a cutter at the apex of the top cover of the secondary air passage 12 if the top cover is formed integrally with the passage in the form of a casting. Also, if the top cover of the secondary air passage 12 is fabricated by thin plate working, the ejecting openings 11 can be formed readily by bending the cover at the middle of the elongated slits. The triangular top portion has an angle $\theta$ which is 100° in the embodiment shown and described above. If the angle $\theta$ becomes larger than 100° such as, for example, in the case of 150°, the proportion of the secondary air ejected through the apex portion to the secondary air ejected through the sloping side portions will increase.

The result of an experiment conducted on the production of oxides of nitrogen from the burner constructed as described above will be described. In these experiments, the amount of oxides of nitrogen produced was 35 ppm ($NO_x$ in terms of 0% of oxygen) and $CO/CO_2$ was 0.0005, when the gas was of $CH_4$, the heat input was 10,000 kcal/h, the load at the flame ports was 7 kcal/h·mm$^2$, the primary air ratio was 1.0, the excess air ratio was 1.6 and the temperatures of the portions of the cooling walls corresponding to the primary reaction region and secondary reaction region of the flames were less than 300° C. Since the production of oxides of nitrogen is inhibited by means of the cooling walls and the supply of secondary air, the amount of oxides of nitrogen produced can be kept at substantially a constant level even if the primary air ratio is reduced or increased.

In the embodiment described above, the secondary air ejecting oepenings 11 are located in a manner such that the jet streams of secondary air pass above the auxiliary flame slits 10. In this arrangement, if the secondary air ejecting openings 11 and the auxiliary flame slits 10 are arranged such that each one of the openings 11 is provided for every other slit 10, the flames can be separated into discrete flame portions of a large number.

Figure 11:
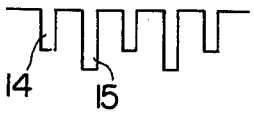
FIGS. 11, 12 and 13 are front views of modifications of the secondary air ejecting opening according to the invention.

Additionally, in the aforesaid embodiment, the lower ends of all the secondary air ejecting ports 11 are disposed at the same level so that secondary air is supplied to the same position of each of the flames. However, as shown in FIG. 11, two types of secondary air ejecting openings 14 and 15 differing in length from one another may be provided in place of the secondary air ejecting openings 11 of the same length. This enables secondary air to be blown onto different portions of the flames, thereby permitting control of cooling of the flames and oxidization of CO to be effected with better results.

Figure 12:
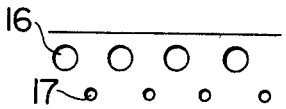
Figure 13:
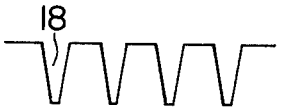

Further modifications of the secondary air ejecting openings are shown in FIGS. 12 and 13. In FIG. 12, secondary air ejecting openings 16 and 17 in the form of large and small circles are formed in positions which correspond to the downstream and upstream portions of the flames, respectively thereby resulting in a larger supply of secondary air being directed to the downstream side of the flame than to an upstream side. Secondary air ejecting openings 18 shown in FIG. 13 are of an inverted triangular shape. Moreover, the secondary air ejecting openings may be arranged such that they are oriented in different directions although they are disposed at the same level.

In the embodiment shown in FIGS. 7 and 8, the main flame ports 8 are each in the form of a slit extending along one of the cooling walls 5. It is to be understood that the auxiliary flame ports 10 may be used as main flame outlets by eliminating the main flame ports 8. If this is the case, a plurality of slits constituting the main flame holes and extending at right angles to the cooling walls 5 may be provided in a manner such that each end of each of the slits is in contact with one of the cooling walls 5. The rate of cooling of the flames can be controlled by providing each one of the secondary air ejecting openings for every other main flame slit. Further, in this case, if a flame port plate provided with the flame ports is made thinner in thickness at the side of the cooling wall than at the side of the secondary air port, a flame portion at the side of the cooling wall becomes a main flame while another flame portion at the side of the secondary air port becomes an auxiliary flame.

In the above-mentioned embodiment, the main flame port is provided in contact with the cooling wall, the secondary reaction region being in contact with the cooling wall, and the secondary air is blown thereto. However, the flame port may be provided in the vicinity of the cooling wall, wherein the flame is made in contact with the cooling wall by the action of the secondary air.

We claim:

1. A process of combustion having a lower $NO_x$ generation rate, comprising the steps of premixing gaseous fuel and a primary air to create a mixture within a combustibility limit with respect to the fuel, generating a flame extending in a parallelly disposed, contacting relationship with respect to a cooling wall by combustion of the mixture so as to form a maximum temperature region slightly downstream of a first reaction region in the flame, and feeding secondary air to the maximum temperature region from a side of the flame opposite to the cooling wall toward the cooling wall.

2. A process as set forth in claim 1, wherein the secondary air feeding step includes feeding secondary air downstream of said maximum temperature region also.

3. A process as set forth in claim 16, wherein said secondary air feeding step comprises providing secondary air ejections arranged in a spaced apart relation along the width of the flame.

4. A process as claimed in claim 3, wherein each of the secondary air ejection streams is elongated and issued in a direction for cutting the flame along its width into a plurality of flame portions.

5. A process as claimed in claim 3, wherein said secondary air ejections are issued in lengths which differ in their extent in the flame issuing direction so that the location at which one secondary air ejection contacts the premix combustion flame differs from that at which an adjacent secondary air ejection contacts the flame.

6. A method according to claim 1, wherein secondary air is blown onto at least a maximum temperature region of at least one gaseous fuel-air premix combustion flame without contacting a flame portion located downstream thereof.

7. A process as claimed in claim 3, wherein a plurality of said premix combustion flames are formed with a predetermined interval therebetween, and a plurality of said secondary air ejections are provided at an interval corresponding to that of each of said flames.

8. A process as claimed in claim 6, wherein the secondary air feeding step is performed so as to supply a larger amount of secondary air to a first premix flame portion than is suplied to a second flame portion that is located upstream relative to said first portion in a flame issuing direction.

9. A process as claimed in claim 8, wherein the step of supplying a larger amount of secondary air to the first flame portion than is supplied to the second flame portion is performed by secondary air ejecting openings that are larger than secondary air ejecting openings from which air is supplied to said second flame portion.

10. A process as claimed in claim 1, wherein the premix combustion flame generating step comprises the step of forming main and auxiliary flames, and wherein the secondary air feeding step comprises directing secondary air flows from a side opposite to the wall upwardly through the auxiliary flames to said main flame.

11. A process as set forth in claim 10, wherein the main flame is elongated in a direction normal to the premix combustion flame issuing direction, a plurality of said auxiliary flames are disposed along said main flame with a predetermined interval therebetween, and a plurality of said secondary air flows are provided toward the premix combustion flame with a predetermined interval therebetween.

12. A process as set forth in claim 1, wherein the secondary air feeding step directs said secondary air from upstream of the maximum temperature region with respect to the issuing direction of the premix combustion flame toward downstream thereof.

* * * * *